US008672023B2

(12) United States Patent
O'Malley

(10) Patent No.: US 8,672,023 B2
(45) Date of Patent: Mar. 18, 2014

(54) APPARATUS AND METHOD FOR COMPLETING WELLS USING SLURRY CONTAINING A SHAPE-MEMORY MATERIAL PARTICLES

(75) Inventor: Edward J. O'Malley, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 360 days.

(21) Appl. No.: 13/074,594

(22) Filed: Mar. 29, 2011

(65) Prior Publication Data

US 2012/0247761 A1 Oct. 4, 2012

(51) Int. Cl.
*E21B 43/04* (2006.01)
*E21B 43/08* (2006.01)

(52) U.S. Cl.
USPC ..... 166/51; 166/278

(58) Field of Classification Search
USPC ..... 166/278, 51, 228
See application file for complete search history.

(56) References Cited

U.S. PATENT DOCUMENTS

| | | | | |
|---|---|---|---|---|
| 7,013,979 | B2 | 3/2006 | Richard | |
| 7,318,481 | B2 | 1/2008 | Richard | |
| 7,644,773 | B2 | 1/2010 | Richard | |
| 7,828,055 | B2 | 11/2010 | Willauer et al. | |
| 2006/0042795 | A1 | 3/2006 | Richards | |
| 2008/0089565 | A1 | 4/2008 | Chui | |
| 2010/0077594 | A1 | 4/2010 | Richard | |
| 2010/0089565 | A1 | 4/2010 | Duan et al. | |
| 2010/0144962 | A1 * | 6/2010 | Jana et al. | 524/590 |
| 2011/0036578 | A1 | 2/2011 | Coronado | |
| 2013/0062061 | A1 * | 3/2013 | Taylor et al. | 166/288 |

OTHER PUBLICATIONS

International Search Report and Written Opinion dated Oct. 29, 2012 for International Application No. PCT/US2012/030859.

* cited by examiner

*Primary Examiner* — Brad Harcourt
(74) *Attorney, Agent, or Firm* — Cantor Colburn LLP

(57) ABSTRACT

In aspects, the present disclosure provides a method of performing a wellbore operation, which in one embodiment includes supplying a mixture containing a fluid and shape memory particles of a first size into a selected region in the wellbore, retaining the shape memory particles of the first size in the selected region while expelling the fluid from the selected region, and activating the shape memory particles retained in the selected region to cause them to expand to attain a second shape to fill the selected region with shape memory particles having the second shape.

18 Claims, 2 Drawing Sheets

APPARATUS AND METHOD FOR COMPLETING WELLS USING SLURRY CONTAINING A SHAPE-MEMORY MATERIAL PARTICLES

BACKGROUND

1. Field of the Disclosure

The disclosure relates generally to performing a wellbore operation utilizing slurry containing sized shape-memory particles.

2. Description of the Related Art

Hydrocarbons, such as oil and gas, are recovered from formations using wellbores drilled into such formations. The drilled wellbore is completed by installing various devices in the wellbore suitable for transporting formation fluids containing hydrocarbons from the formation to the surface. In certain types of completions a sand screen is placed between the wellbore inside and a production tubing configured to carry the formation fluid to the surface. The annulus between the wellbore inside and the sand screen is packed with gravel (also referred to as "sand"). The gravel provides primary filtration, and stabilizes the wellbore, allowing the hydrocarbons to flow therethrough to the sand screen and into the production tubing.

Often, a gravel pack includes gaps (voids) formed during the packing process, which are difficult to fill after the gravel pack has been accomplished. Voids in gravel packs are detrimental to a well's performance because the flow velocity in the area can become high, causing erosion of the sand screen and an eventual filtration failure. The disclosure herein provides apparatus and methods for filling or packing selected regions in a wellbore, including the annulus, with sized particles of a shape-memory material that addresses some of the above-noted deficiencies.

SUMMARY

In aspects, the present disclosure provides a method of performing a wellbore operation comprising: supplying a mixture containing a fluid and particles of a shape-memory material of a first size into a selected region in the wellbore; retaining the particles of the shape-memory material of the first size in the selected region while expelling the fluid from the selected region; and activating the shape-memory particles retained in the selected region to attain a second expanded shape to fill the selected region with the expanded shape-memory particles.

In other aspects, the disclosure provides a wellbore system that, in one embodiment includes a tool placed at a selected location in the wellbore, a space defined by the tool and the wellbore; and shape memory particles in the space, wherein the shape memory particles were: (i) placed in the space in a first compressed state; and (ii) activated downhole to attain a second expanded shape to cause the shape memory particles to fill the space.

Examples of certain features of the apparatus and method disclosed herein are summarized rather broadly in order that the detailed description thereof that follows may be better understood. There are, of course, additional features of the apparatus and the method disclosed hereinafter that will form the subject of the claims.

BRIEF DESCRIPTION OF THE DRAWINGS

The advantages and further aspects of the disclosure are best understood by reference to the following detailed description in conjunction with the accompanying drawings in which like reference characters generally designate like or similar elements and wherein.

DETAILED DESCRIPTION

The present disclosure relates to placing sized shape memory particles in downhole spaces for controlling flow of fluids. In one aspect, the disclosure provides apparatus and methods of forming shape-memory particles in suitable shapes and sizes for transportation of such particles to selected spaces in a wellbore, transporting and placing or packing such shaped-memory particles in the selected spaces and activating such placed particles to conform to the selected spaces and allowing certain fluids to flow therethrough while blocking passage of solids of certain sizes present in such fluids.

Figure 1:
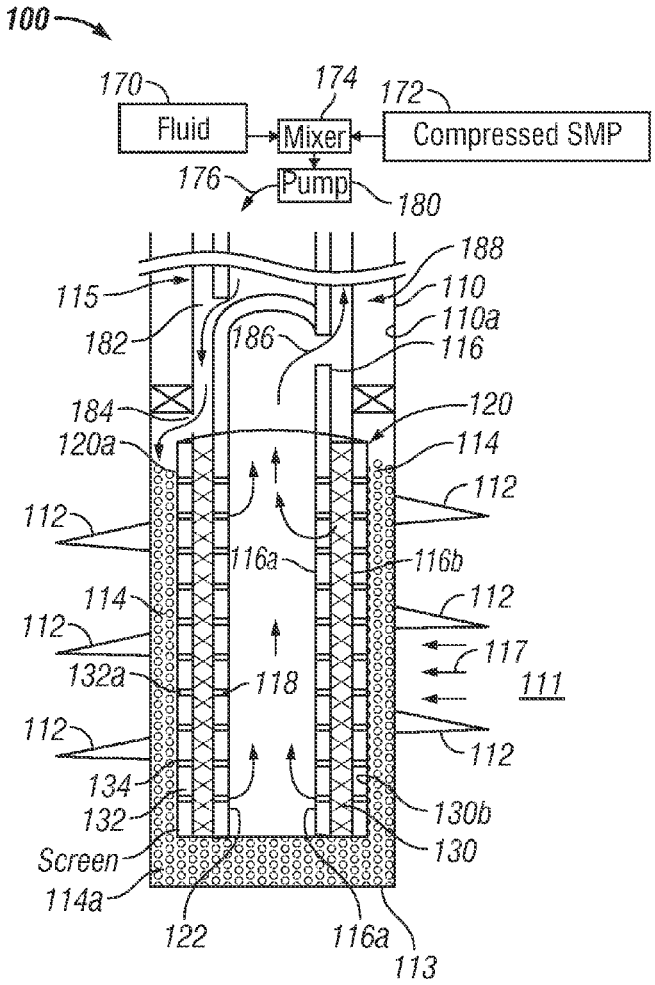
FIG. 1 is a line diagram of an exemplary wellbore system in which a selected space is filled with shape memory particles, according to one embodiment of the disclosure.

FIG. 1 is a line diagram of an exemplary wellbore system 100 showing placement of shape-memory particles (i.e., particles formed from one or more suitable shape memory materials) in a selected space in a wellbore. System 100 shows a wellbore 110 formed in a rock formation 111 (formation) to a depth 113. The wellbore 110 is shown having perforations 112 in the formation 111. Perforation 112 enables the formation fluid (oil, gas and water) 117 to flow from the formation 111 to the inside 110*a* of the wellbore 110. System 100 further shows a production string 115 deployed in the wellbore 110. The production string 115 includes a production tubing or base pipe 116 having openings or fluid passages 118 configured to allow the formation fluid 117 to flow from the formation 111 to the inside 116*a* of the base pipe 116. The section of base pipe 116 having openings 118 is placed across from the perforations 112 of the formation so that the formation fluid 117 can flow into the base pipe 116. The system 100 further shows a sand screen 120 placed around the base pipe 116 to control flow of the formation fluid 117 into the base pipe 116.

Figure 2:
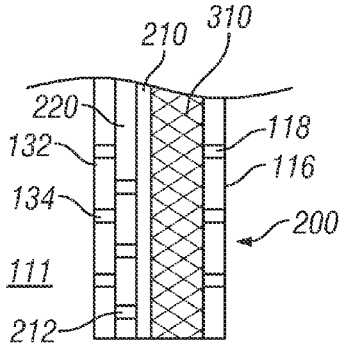
FIG. 2 shows a cross-section of the selected space after the shape memory particles have been placed in the selected space, according to one embodiment of the disclosure.

In one aspect, sand screen 120 is dimensioned so as to form an annular space 114 ("annulus") between the outside 120*a* of the sand screen 120 and the inside 110*a* of the wellbore 110. In this particular embodiment, the annular space 114 is the selected space that is to filled or packed with shape-memory particles according to the methods described herein. The sand screen 120 is shown placed around or wrapped around the outside 116*b* of the base pipe 116. A shroud 132 containing fluid passages 134 is placed around the outside 130*b* of a mesh 130. In this manner, the assembly of mesh 130 and shroud 132 forms a unit surrounding the openings 118 of the base pipe 116. FIG. 2 shows a cross-section of sand screen 200 in which a spacer member 210 having fluid passages 212 is disposed between the mesh 130 and the shroud 132 to create a fluid passage 220 to facilitate flow of the formation fluid 117 into the mesh 130. The mesh 130 may be made of any configuration utilizing any suitable material. In one aspect, the mesh 130 is dimensioned or configured to prevent passage of solid particles contained in the formation fluid 117 from flowing through the mesh and into the base pipe 116. Various types of sand screens are in commercial use and are therefore not described herein in more detail. Although a sand screen is shown herein as a downhole tool for defining the selected space 124, any other suitable device may be utilized to define any space as the space to be filled by the shape-memory particles, according to the methods described herein.

For the purposes of this disclosure a suitable shape-memory material is any material that can be maintained in a first (compressed) form or state at a first lower temperature (also referred herein as the "pre-deployment" temperature) and then expanded to a second form or state when subjected to a higher temperature. Shape-memory materials of various types are commercially available and are thus not described in detail here.

Still referring to FIG. 1, in one aspect, a suitable shape-memory material may first be formed in a bulk volume form of any suitable size and shape. In one aspect, the bulk volume may be activated to lower its elastic modulus, such as by heating the material to or above its glass transition temperature (referred to herein as the "expanded volume" or "expanded state"). The expanded volume is then compressed or compacted while cooling the material to the ambient temperature (also referred to herein as the 'pre-deployment temperature"). Once the compressed bulk volume cools to the pre-deployment temperature, the shape memory material remains in the compressed shape until re-heated. The compressed bulk volume may be broken down into smaller-sized particles. The sizes and shapes of the smaller particles chosen depend upon the intended application. FIGS. 3A-3G show various shapes in which the smaller shape memory particles may be made from the compressed bulk volume. Any other shape may also be used. The size and shape of the smaller shape-memory particles is selected such that it can be advantageously transported to the intended location (selected space) in a fluid mixture but not pass through the mesh, such as mesh 130 shown in FIG. 1, as well as to facilitate optimal packing of the particles in both the compressed and deployed state.

Figure 4A:
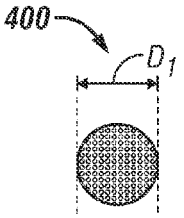
FIG. 4A shows an exemplary shape memory particle after it has been activated.
Figure 4B:
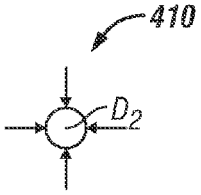
FIG. 4B shows the shape memory particle of FIG. 4A after it has been compressed and held at an ambient temperature.

FIG. 4A shows an exemplary shape memory particle 400 in an expanded state and FIG. 4B shows the particle 400 in a compressed state 410. In this particular case, the shape-memory material is heated to or above its glass transition temperature and then compressed by a suitable physical device or means while reducing the temperature to or below the pre-deployment temperature. Once the shape-memory particle is cooled below the deployment temperature, the shape-memory particle will remain in the compressed state 410, until activated (stimulated), such as by heating it to or above its glass transition temperature. Once activates, the shape-memory particle will attain its expanded size and shape, until it is compressed while cooling it to a temperature below its glass transition temperature. As used herein, the term "memory" refers to the capability of a material to withstand certain stresses, such as external mechanical compression, vacuum and the like, but to then return, under appropriate conditions, such as exposure to a selected form of energy, often heat, to the material's original size and shape. As used herein, the term "shape-memory" refers to the capacity of the material to be heated above the material's glass transition temperature (GTT), and then to be compressed and cooled to a lower temperature, retaining its compressed state. However, the same material may then be restored to its original shape and size, i.e., its pre-compressed state, by reheating that material to close to or above its glass transition temperature (GTT). Such materials may include certain syntactic and conventional foams that may be formulated to achieve a desired GTT for a given application. For instance, a foam material may be formulated to have a GTT below the anticipated downhole temperature at the depth at which the material will be used. The chosen material may include a conventional foam or a combination of different foams and other materials and may be selected from a group consisting of polyurethanes, polystyrenes, polyethylenes, epoxies, rubbers, fluoroelastomers, nitriles, ethylene propylene diene monomers (EPDM), other polymers or combinations thereof. This medium may contain a number of additives and/or other formulation components that alter or modify the properties of the resulting shape memory material. Also, the shape-memory particles packed in the selected spaces may include different shapes and sized and may be made using different types of shape-memory materials.

Referring back to FIG. 1, to fill the space 114 with the shape memory particles, compressed particles 172 of one or more selected sizes are mixed with suitable fluid 170, such as water, in a mixer 174 at the surface. The fluid and shape memory particle mixture 176 is pumped into the tubing 116 by a pump 180, which fluid crosses over into the space 124 via crossover 184. The shape memory particles 172 in the fluid mixture 176 deposit in the space 114 and at the bottom 114*a* of the wellbore 110, while the fluid 170 in the mixture 176 passes into the base pipe 116 openings 132 of the shroud, mesh 130 and openings 118 in the base pipe 116. The fluid 170 then circulates to the surface via a crossover 186 and passage 188. Once the spaces 114 and 114*a* have been filled or packed with the shape memory particles 172, the pumping of the mixture 176 is stopped and the equipment used for such pumping is removed.

Still referring to FIG. 1, the temperature of the formation is often above the glass transition temperature of the shape memory particles 172 in spaces 114 and 114*a*. In such a case, the formation fluid 117 will heat the shape-memory particles 172 to a temperature above its glass transition temperature, thereby causing such particles to expand and fill voids left from packing of such particles in spaces 114 and 114*a*. Also, expansion of the shape-memory particles in spaces 114 and 114*a* will also cause the shape-memory particles packed in the spaces 124 and 124*a* to conform to the inside 110*a* of the wellbore 110 and the outside 132*a* of the shroud 132. In certain cases, however, the formation temperature may be below the glass transition temperature of the shape-memory particles and thus unable to activate such particles in the selected region 124. In such and other desired cases, the foam-memory particles having a glass transition temperature (Tg1) may be placed in the selected region 124 as described above. A suitable material, such as chemical, is then pumped into the selected region 124 to temporarily decrease the glass transition temperature of the foam-memory particles therein to Tg2—a temperature at which the formation temperature will be able to activate the shape-memory particles. Decreasing the glass transition temperature below the formation temperature may be accomplished by any known mechanism or method, including, but not limited to pumping a suitable chemical into the packed region 124. The foam-memory particles will then expand because the formation temperature is near or above Tg2. Over time, the glass transition temperature-lowering fluid may be displaced by well production or the addition of a completion fluid, causing the glass transition temperature of the foam-memory particles to rise above Tg2.

The expanded foam-memory particles will then become near rigid again, because their glass transition temperature will now be below Tg1.

Figure 5:
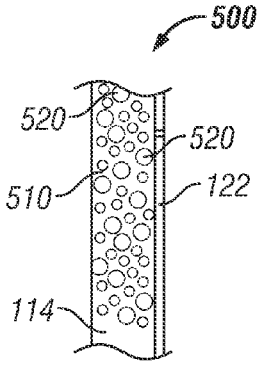
FIG. 5 shows the shape memory particles in the selected space of FIG. 1 after they have been activated.
Figure 3A:
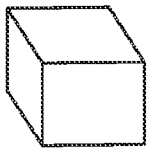
FIGS. 3A-3G show a variety of shapes of a shape memory particle that may be utilized for packing a selected space.
Figure 3B:
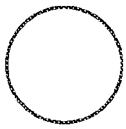
Figure 3C:
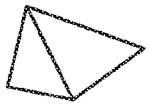
Figure 3D:
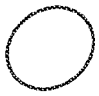
Figure 3E:
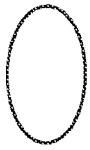
Figure 3F:
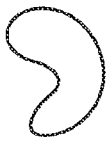
Figure 3G:
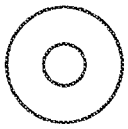

FIG. 5 shows an example of the shape-memory particles 172 in the annular space 114 after they have expanded. FIG. 5 shows certain shape-memory particles 520 in expanded states within the space 114. The ultimate shape of expanded particles 520 will depend upon their respective initial compressed shape and size upon deployment in space 114, relative placement of such particles with respect to each other in the space 114 and size and shape of any voids present in space 114. Alternatively, or in addition to, using heat from the formation fluid 117, an artificial stimulus may be utilized to expand the particle 172 in spaces 114 and 114*a*. Such an artificial stimulus may be in the form of heat supplied to space 114 via conduits 180. Other forms of stimuli may include supply of electromagnetic waves, acoustic signals or any other stimulus that can activate the particular shape-memory particles 172.

Thus, in one aspect, the disclosure herein provides a method of performing a wellbore operation that in one embodiment includes supplying a mixture containing a fluid and shape-memory particles of a first (compressed) size into a selected region in the wellbore, retaining the shape-memory particles of the first compressed size in the selected region while expelling the fluid from the selected region, and activating the shape-memory particles retained in the selected region to cause them to attain a second expanded shape. In one aspect, the shape-memory particles of the first size are particles obtained by compressing the shape-memory material at a temperature above a glass transition temperature of the shape-memory material while cooling the compressed shape-memory material to a temperature below the glass transition temperature of the shape-memory material. In one aspect, the shape-memory material is a foam material. In another aspect, the method may further include expelling the fluid in the mixture from the selected region before activating the retained shape-memory particles in the selected region. In another aspect, the method may further include producing a formation fluid through the retained shape-memory particles after activating the retained shape-memory particles in the selected region. In yet another aspect, the shape-memory particles may be activated by supplying heat to the shape-memory particles in the selected space from a source or allowing heat from the formation to heat the shape-memory particles to or above the glass transition temperature of such particles. In another aspect, the selected region is a region between a sand screen and a wellbore wall. In one aspect, the sand screen includes a screen configured to allow the fluid to pass therethrough and prevent passage of the compressed shape-memory material particles therethrough. In yet another aspect, supplying the fluid mixture includes supplying the fluid mixture from a first passage into the selected space and allowing the fluid to flow to the surface through a second passage after it exits the sand screen.

In another aspect, the method of packing a sand control material in a selected space in a wellbore may include: placing a string in the wellbore that includes a screen having perforations of a first size and a fluid flow path inside the screen, wherein a space between the screen and the wellbore defines the selected space; placing shape-memory particles of a first size in the selected region, expanding the shape-memory particles in the selected region to a second size larger than first size; allowing a formation fluid to flow from a formation into the string while preventing solids from entering into the string. In one aspect, placing the shape-memory particles in the selected region includes mixing a fluid and compressed shape-memory particles to form slurry, and pumping the slurry into the selected region. In another aspect, expanding the shape-memory particles in the selected region may be accomplished by supplying steam to the shape-memory particles and allowing heat from the formation to heat the shape-memory particles in the selected space above the glass transition temperature of such particles. In another aspect, the shape-memory material may include carbon nanoparticles that may be heated to heat the shape-memory particles to or above glass transition temperature. In another aspect, the expanded shape-memory particles may be temporarily cooled below glass transition temperature to cause them to compress in the selected space.

In another aspect, the disclosure provides a system that includes a string in a wellbore and a selected region packed with shape-memory particles, wherein the selected region has been packed with the shape-memory particles by placing shape-memory particles of a first size in the selected region by supplying a mixture of a fluid and the shape-memory particles of a first size, retaining the shape-memory particles of the first size in the selected region while removing the fluid from the selected region and activating the shape-memory particles of the first size in the selected region to cause such particles to expand to a second size so as to pack the selected region with the shape-memory particles of the second size. In one aspect, the string may include any suitable tool, including, but not limited to sand screen for defining the selected region in the wellbore. In one configuration, the sand screen includes a shroud and a mesh inside the shroud, wherein the mesh is placed around outside of a base pipe.

In yet another aspect, the disclosure provides an apparatus for packing a selected region in a wellbore, wherein the apparatus in one configuration includes a device in the wellbore defining a selected space between the an outside of the device and an inside of the wellbore, wherein the device includes a member having perforations, a first passage for supplying a mixture of a fluid and particles of a shape-memory material into the selected region, a second passage inside the member for allowing the fluid to flow from the selected region to a surface location region, and a source configured to supply the mixture into the selected region via the first passage.

While the foregoing disclosure is directed to the preferred embodiments of the disclosure, various modifications will be apparent to those skilled in the art. It is intended that all variations within the scope and spirit of the appended claims be embraced.

The invention claimed is:

1. A method of performing a wellbore operation, comprising:

supplying a mixture containing a fluid and shape-memory particles of a first size into a selected region in the wellbore;

retaining the shape-memory particles of the first size in the selected region, while expelling the fluid from the selected region;

supplying a selected fluid to the shape-memory particles in the selected region to lower a glass transition temperature of the shape-memory particles from a first glass transition temperature to a second glass transition temperature; and heating the shape-memory particles above the second glass transition temperature to activate the retained shape-memory particles of the first size in the selected region to cause at least some of the retained shape-memory particles to attain a second size greater than the first size.

2. The method of claim 1, wherein the shape-memory particles of the first size are particles obtained by compressing a shape-memory material at a temperature above a glass transition temperature of the shape-memory material while cooling the compressed shape-memory material to a temperature below the glass transition temperature of the shape-memory material.

3. The method of claim 2, wherein the shape-memory material is a foam material.

4. The method of claim 1 further comprising producing a formation fluid through the retained particles of the shape-memory material after activating the retained particles of the shape-memory material in the selected region.

5. The method of claim 1, wherein activating the retained particles of the shape-memory material comprises one of: supplying heat to the retained shape-memory particles from the surface; and allowing heat from the formation to heat the retained shape-memory particles.

6. The method of claim 1, wherein the selected region is between a downhole device and a wellbore wall.

7. The method of claim 6, wherein the device is a sand screen.

8. The method of claim 6, wherein the device includes a first passage for supplying the mixture into the selected region and a second passage for transporting the fluid out of the selected region.

9. A method of packing a selected region in a wellbore with sand control particles, the method comprising:

placing a string in the wellbore containing a device that includes a screen having openings of a first size, the device defining the selected region between the device and a wall of the wellbore;

supplying a mixture containing a fluid and shape-memory particles of a second size into the selected region, wherein the second size is larger than the first size, thereby allowing the particles of the shape-memory material to remain in the selected region and enabling the fluid in the mixture to flow into the fluid flow path inside the screen;

supplying a selected fluid to the shape-memory particles in the selected region to lower a glass transition temperature of the shape-memory particles from a first glass transition temperature to the second glass transition temperature; and heating the shape-memory particles above the second glass transition temperature to activate the shape-memory particles in the selected region to cause such particles to expand to a third size so as to pack the selected region with the shape-memory particles that includes particles of the third size.

10. The method of claim 9, wherein supplying the mixture comprises:

mixing the fluid and shape-memory particles of the second shape to form a slurry; and pumping the slurry into the selected region.

11. The method of claim 9, wherein activating the shape-memory particles in the selected region comprises one of: supplying heat to the shape-memory particles in the selected region; and allowing heat from the formation to heat the shape-memory particles in the selected region to or above the second glass transition temperature of the shape-memory particles.

12. The method of claim 9, wherein the shape-memory particles include carbon nanoparticles and wherein activating the shape-memory particles comprises heating the carbon nanoparticles.

13. A wellbore system, comprising:

a string having a downhole tool in the wellbore defining a selected region in the wellbore; and shape-memory particles packed in the selected region, wherein the shape-memory particles have been packed by:

placing the shape-memory particles of a first size in the selected region by supplying a mixture of a fluid and the shape-memory particles of the first size to the selected region, retaining the shape-memory particles of the first size in the selected region while removing the fluid from the selected region, supplying a selected fluid to the shape-memory particles in the selected region to lower a glass transition temperature of the shape-memory particles from a first glass transition temperature to the second glass transition temperature, and heating the shape-memory particles above the second glass transition temperature to activate the shape-memory particles of the first size in the selected region to cause such particles to expand to a second size so as to pack the selected region with the shape-memory particles that include shape-memory particles of the second size.

14. The system of claim 13, wherein the downhole tool is a sand screen and wherein the selected region is defined by a space between the sand screen and a wellbore wall.

15. An apparatus for packing a selected region with shape-memory particles in a wellbore, comprising:

a device in the wellbore defining a selected space between the device and an inside of the wellbore, wherein the device includes:

a member having openings, a first passage for supplying a mixture of a fluid and shape-memory particles into the selected region, a second passage in the member for allowing the fluid to flow out of the selected region into the member; and a source configured to supply the mixture into the selected region via the first passage.

16. A method of performing a wellbore operation, comprising:

placing shape-memory particles of a first size into a selected region in the wellbore, the shape-memory particles of the first size having a first glass transition temperature;

reducing the first glass transition temperature of the shape-memory particles in the selected region to a second glass transition temperature;

heating the shape-memory particles in the selected region to a temperature to or above the second glass transition temperature to cause at least some of the shape-memory particles of the first size to expand to a second size;

wherein reducing the glass transition temperature of the shape-memory particles in the selected region comprises supplying a selected fluid to the shape-memory particles in the selected region configured to lower the glass transition temperature to the second glass transition temperature.

17. The method of claim 16, wherein the first glass transition temperature is above temperature of a formation proximate to the selected region and the second glass transition temperature is below the temperature of the formation proximate to the selected region.

18. The method of claim 16 further comprising removing the selected fluid from the selected region after the glass transition temperature of the shape-memory particles in the selected region has been reduced to the second glass transition temperature.

* * * * *